US012025384B2

(12) United States Patent
Holm et al.

(10) Patent No.: US 12,025,384 B2
(45) Date of Patent: Jul. 2, 2024

(54) HEAT TRANSFER PLATE

(71) Applicant: ALFA LAVAL CORPORATE AB, Lund (SE)

(72) Inventors: Martin Holm, Lund (SE); Magnus Hedberg, Hjärup (SE); Johan Nilsson, Ronneby (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 18/257,476

(22) PCT Filed: Nov. 25, 2021

(86) PCT No.: PCT/EP2021/082954
§ 371 (c)(1),
(2) Date: Jun. 23, 2023

(87) PCT Pub. No.: WO2022/128387
PCT Pub. Date: Jun. 23, 2022

(65) Prior Publication Data

US 2023/0400257 A1 Dec. 14, 2023

(30) Foreign Application Priority Data

Dec. 15, 2020 (EP) ..... 20214277

(51) Int. Cl.
*F28D 9/00* (2006.01)
*F28F 3/04* (2006.01)

(52) U.S. Cl.
CPC ..... *F28D 9/005* (2013.01); *F28F 3/046* (2013.01)

(58) Field of Classification Search
CPC ..... F28D 9/0037; F28D 9/0043; F28D 9/005; F28F 3/083; F28F 3/046
See application file for complete search history.

(56) References Cited

U.S. PATENT DOCUMENTS 3,783,090 A * 1/1974 Andersson et al. ..... F28F 3/04 165/166
4,781,248 A * 11/1988 Pfeiffer ..... F28F 3/042 165/166

(Continued)

FOREIGN PATENT DOCUMENTS

CN 104797901 A 7/2015
CN 111164367 A 5/2020

(Continued)

OTHER PUBLICATIONS

"Gasketed Plate Heat Exchanger", SmartClima, 1 page, retrieved from http://www.smartclima.comm10b-gasketed-plate-heal-exchanger, publication date unknown, but at least as early as Dec. 15, 2020.

(Continued)

*Primary Examiner* — Jianying C Atkisson
*Assistant Examiner* — For K Ling
(74) *Attorney, Agent, or Firm* — BUCHANAN INGERSOLL & ROONEY PC

(57) ABSTRACT

A heat transfer plate comprises an upper end portion adjoining a center portion along an upper border line and comprising first and second port holes and an upper distribution pattern comprising upper distribution ridges and valleys. The upper distribution ridges extend along imaginary upper ridge lines from the upper border line towards the first port hole. The upper distribution valleys extend along imaginary upper valley lines from the upper border line towards the second port hole. The imaginary upper ridge lines and valley lines cross in plural upper cross points. In plural upper cross points, the plate extends in an imaginary first intermediate plane. The plate is configured so that a number of first upper cross points on one side of the center axis extends above the first intermediate plane, and a number of second upper cross (Continued)

points on another side of such axis extends below the first intermediate plane.

15 Claims, 4 Drawing Sheets

(56) References Cited

U.S. PATENT DOCUMENTS

| | | | | |
|---|---|---|---|---|
| 4,915,165 | A * | 4/1990 | Dahlgren | F28F 3/046 165/166 |
| 5,398,751 | A * | 3/1995 | Blomgren | F28F 3/046 165/166 |
| 5,531,269 | A * | 7/1996 | Dahlgren | F28D 9/005 165/167 |
| 2011/0139419 | A1* | 6/2011 | Blomgren | F28D 9/005 165/170 |
| 2020/0025465 | A1* | 1/2020 | Kim | F28F 3/083 |
| 2021/0396479 | A1 | 12/2021 | Tissot et al. | |

FOREIGN PATENT DOCUMENTS

| | | | |
|---|---|---|---|
| EP | 3043139 | A1 | 7/2016 |
| EP | 2728292 | B1 | 10/2016 |
| EP | 1899671 | B1 | 12/2016 |
| EP | 2957851 | B1 | 5/2017 |
| EP | 3 404 350 | A1 | 11/2018 |
| EP | 3467423 | A1 | 4/2019 |
| EP | 3587984 | A1 | 1/2020 |
| EP | 3 608 620 | A2 | 2/2020 |
| EP | 3650795 | A1 | 5/2020 |
| EP | 3657114 | A1 | 5/2020 |
| FR | 3 086 376 | A1 | 3/2020 |
| GB | 1 288 887 | A | 9/1972 |
| GB | 1 468 514 | A | 3/1977 |
| JP | H06241672 | A | 9/1994 |
| JP | 2012-052800 | A | 3/2012 |
| JP | 2012-082990 | A | 4/2012 |
| JP | 2015534020 | A | 11/2015 |
| JP | 2020-012630 | A | 1/2020 |
| RU | 177117 | U1 | 2/2018 |
| RU | 192250 | U1 | 9/2019 |
| SE | 527611 | C2 | 4/2006 |
| WO | 2014067674 | A1 | 5/2014 |
| WO | 2015/040353 | A1 | 3/2015 |
| WO | 2017/122428 | A1 | 7/2017 |

OTHER PUBLICATIONS

"Innovative Plate Technology", 1 page, publication date unknown.
"Sondex", 3 pages, publication date unknown.
European Search Report dated Apr. 29, 2021, by the European Patent Office for Application No. 20214277.4. (2 pages).
International Search Report (PCT/ISA/210) with translation and Written Opinion (PCT/ISA/237) dated Feb. 9, 2022, by the European Patent Office as the International Searching Authority for International Application No. PCT/EP2021/082954. (9 pages).
Intention to Grant dated Jan. 12, 2023, by the European Patent Office in counterpart European Application No. 20214277.4, (5 pages).
"Gasketed Plate Heat Exchanger", SmartClima, 1 page, retrieved from http://www.smartclima.comm10b-gasketed-plate-heal-exchanger, publication date unknown, but before Dec. 15, 2020.
"Innovative Plate Technology", 1 page, publication date unknown, but before Dec. 15, 2020.
"Sondex", 3 pages, publication date unknown, but before Dec. 15, 2020.
Office Action (The First Office Action) dated Oct. 10, 2023, by the National Intellectual Property Administration, P. R. China in corresponding Chinese Patent Application No. 202180083855.3 and an English translation of the Office Action. (10 pages).
Office Action (Notice of Preliminary Rejection) dated Oct. 27, 2023, by the Korean Intellectual Property Office in corresponding Korean Patent Application No. 10-2023-7024044 and an English translation of the Office Action. (13 pages).
Office Action (Notice of Reasons for Rejection) issued on Jan. 22, 2024, in corresponding Japanese Patent Application No. 2023-536162 and English translation of the Office Action. (6 pages).

* cited by examiner

HEAT TRANSFER PLATE

TECHNICAL FIELD

The invention relates to a heat transfer plate and its design.

BACKGROUND ART

Plate heat exchangers, PHEs, typically consist of two end plates in between which a number of heat transfer plates are arranged aligned in a stack or pack. The heat transfer plates of a PHE may be of the same or different types and they may be stacked in different ways. In some PHEs, the heat transfer plates are stacked with the front side and the back side of one heat transfer plate facing the back side and the front side, respectively, of other heat transfer plates, and every other heat transfer plate turned upside down in relation to the rest of the heat transfer plates. Typically, this is referred to as the heat transfer plates being "rotated" in relation to each other. In other PHEs, the heat transfer plates are stacked with the front side and the back side of one heat transfer plate facing the front side and back side, respectively, of other heat transfer plates, and every other heat transfer plate turned upside down in relation to the rest of the heat transfer plates. Typically, this is referred to as the heat transfer plates being "flipped" in relation to each other.

In one type of well-known PHEs, the so called gasketed PHEs, gaskets are arranged between the heat transfer plates. The end plates, and therefore the heat transfer plates, are pressed towards each other by some kind of tightening means, whereby the gaskets seal between the heat transfer plates. Parallel flow passages are formed between the heat transfer plates, one passage between each pair of adjacent heat transfer plates. Two fluids of initially different temperatures, which are fed to/from the PHE through inlets/outlets, can flow alternately through every second passage for transferring heat from one fluid to the other, which fluids enter/exit the passages through inlet/outlet port holes in the heat transfer plates communicating with the inlets/outlets of the PHE.

Typically, a heat transfer plate comprises two end portions and an intermediate heat transfer portion. The end portions comprise the inlet and outlet port holes and distribution areas pressed with a distribution pattern of ridges and valleys. Similarly, the heat transfer portion comprises a heat transfer area pressed with a heat transfer pattern of ridges and valleys. The ridges and valleys of the distribution and heat transfer patterns of the heat transfer plate are arranged to contact, in contact areas, the ridges and valleys of distribution and heat transfer patterns of adjacent heat transfer plates in a plate heat exchanger. The main task of the distribution areas of the heat transfer plates is to spread a fluid entering the passage across the width of the heat transfer plates before the fluid reaches the heat transfer areas, and to collect the fluid and guide it out of the passage after it has passed the heat transfer areas. On the contrary, the main task of the heat transfer area is heat transfer.

Since the distribution areas and the heat transfer area have different main tasks, the distribution pattern normally differs from the heat transfer pattern. The distribution pattern may be such that it offers a relatively weak flow resistance and low pressure drop which is typically associated with a more "open" pattern design offering relatively few, but large, elongate contact areas between adjacent heat transfer plates. The heat transfer pattern may be such that it offers a relatively strong flow resistance and high pressure drop which is typically associated with a more "dense" pattern design offering more, but smaller, point-shaped contact areas between adjacent heat transfer plates.

Conventional distribution patterns typically define flow channels across the distribution areas of a heat transfer plate in which channels a fluid should flow when passing the distribution areas. Two opposing flow channels of two adjacent heat transfer plates in a plate heat exchanger form a flow tunnel. A relatively uniform spread of the fluid across the plate is essential for a high heat transfer capacity of the plate. A uniform fluid spread typically requires that essentially the same amount of fluid is fed through each of the flow channels. However, the flow channels are normally of different lengths and since the fluid typically strives to take the shortest way when passing the distribution areas, there may be a fluid leakage between the flow channels resulting in an uneven fluid spread across the plate.

SUMMARY

An object of the present invention is to provide a heat transfer plate which at least partly solves the above discussed problem of prior art. The basic concept of the invention is to locally, where the distribution area of the heat transfer plate is most prone to fluid leakage between flow channels, adjust the design of the distribution area to reduce the risk of fluid leakage and thereby the risk of an uneven fluid spread across the plate. The heat transfer plate, which is also referred to herein as just "plate", for achieving the object above is defined in the appended claims and discussed below.

A heat transfer plate according to the invention comprises an upper end portion, a center portion and a lower end portion arranged in succession along a longitudinal center axis of the heat transfer plate. The upper end portion comprises a first and a second port hole and an upper distribution area provided with an upper distribution pattern. The lower end portion comprises a third and a fourth port hole and a lower distribution area provided with a lower distribution pattern. The center portion comprises a heat transfer area provided with a heat transfer pattern differing from the upper and lower distribution patterns. The upper end portion adjoins the center portion along an upper border line and the lower end portion adjoins the center portion along a lower border line. The upper distribution pattern comprises upper distribution ridges and upper distribution valleys, which may be elongate. A respective top portion of the upper distribution ridges extends in an imaginary upper plane and a respective bottom portion of the upper distribution valleys extends in an imaginary lower plane. The upper and lower planes define, in a thickness direction, an extreme extension of the heat transfer plate within the upper distribution area. The upper distribution ridges longitudinally extend along a plurality of separated imaginary upper ridge lines extending from the upper border line towards the first port hole. The upper distribution valleys longitudinally extend along a plurality of separated imaginary upper valley lines extending from the upper border line towards the second port hole. The imaginary upper ridge lines cross the imaginary upper valley lines in a plurality of upper cross points. In a plurality of the upper cross points the heat transfer plate extends in an imaginary first intermediate plane extending between the upper and lower planes. The heat transfer plate is characterized in that the heat transfer plate, in a number of first upper cross points of the upper cross points arranged on one side of the longitudinal center axis, extends above the first intermediate plane. Further, in a number of second upper cross points of the upper cross points arranged on another side of the longitudinal center axis, the heat transfer plate extends below the first intermediate plane.

Herein, by "extreme extension" is meant an extension beyond which something, or more particularly a center of something, does not extend. The upper and lower planes may or may not be extreme planes of the complete heat transfer plate.

The number of first upper cross points 1 and the number of second upper cross points 1. The number of first upper cross points and the number of second upper cross points may, or may not, be the same.

Herein, if not stated otherwise, the ridges and valleys of the heat transfer plate are ridges and valleys when a front side of the heat transfer plate is viewed. Naturally, what is a ridge as seen from the front side of the plate is a valley as seen from an opposing back side of the plate, and what is a valley as seen from the front side of the plate is a ridge as seen from the back side of the plate, and vice versa.

Throughout the text, when referring to e.g. a line extending from something towards "something else", the line does not have to extend straight, but may extend obliquely or curved, towards "something else".

Herein, by plurality is meant more than one.

The upper and lower planes may be parallel to each other. Further, the first intermediate plane may be parallel to one or both of the upper and lower planes.

The upper ridge lines define flow channels through the upper distribution area on a front side of the heat transfer plate while the upper valley lines define flow channels through the upper distribution area on an opposite back side of the heat transfer plate. As discussed above, a proper fluid distribution across the heat transfer plate typically requires an essentially equal fluid flow through the flow channels. However, leakage between the flow channels may prevent this. According to the present invention, the extension of the heat transfer plate can be locally raised between adjacent ones of the upper distribution ridges arranged along one and the same of the imaginary upper ridge lines, and locally lowered between adjacent ones of the upper distribution valleys arranged along one and the same of the imaginary upper valley lines to locally "close" the corresponding flow channels. Thereby, leakage between adjacent flow channels may be reduced or prevented. By having the first and second cross points arranged on different sides of the longitudinal center axis, local "closing" can be achieved where needed the most, i.e. where leakage is most likely to occur, on the front as well as the back side of the heat transfer plate. Also, even flows may be achieved on the front and back sides of the heat transfer plate. Further, such a configuration may enable a pack of plates, which are designed according to the present invention, being "flipped" as well as "rotated" in relation to each other.

The heat transfer plate may be so designed that said first cross points are arranged on the same side of the longitudinal center axis as the second port hole, and the second cross points are arranged on the same side of the longitudinal center axis as the first port hole. By this design, local "closing" can be achieved where needed the most, i.e. where leakage is most likely to occur, on the front as well as the back side of the heat transfer plate.

The heat transfer plate may, in said first upper cross points, extend in the upper plane and, in said second upper cross points, extend in the lower plane. Such a design enables complete or maximum "closing" of the flow channels which may minimize leakage between the flow channels.

At least one of said first upper cross points may be arranged along a second top upper ridge line of the upper ridge lines, which second top upper ridge line is arranged second closest, of the upper ridge lines, to the second port hole. The second top upper ridge line is typically the one of the upper ridge lines along which fluid leakage is most likely to occur.

The heat transfer plate may be so designed that more of said first upper cross points are arranged along the second top upper ridge line than along any of the other upper ridge lines. In other words, according to this embodiment the second top upper ridge line is the upper ridge line along which the largest number of first upper cross points is arranged. The second top upper ridge line is typically the second longest one of the upper ridge lines.

The first upper cross points may be arranged along the $x \geq 1$ longest ones of the upper ridge lines arranged on an inside of a first top upper ridge line of the upper ridge lines, which first top upper ridge line is arranged closest, of the upper ridge lines, to the second port hole. Further, at least one of said first upper cross points may be arranged along each one of said x longest ones of the upper ridge lines. As said above, the second longest one of the upper ridge lines is typically the second top upper ridge line. According to this embodiment the first upper cross points are arranged along the x longest consecutive upper ridge lines arranged on the inside of the first top upper ridge line, typically including the second top upper ridge line. As previously discussed, fluid leakage is most likely to occur from a longer flow channel, i.e. along the longer upper ridge lines. However, fluid leakage does normally not occur along the first top upper ridge line since a sealing, such as a gasket, typically is provided on an outside of the first top upper ridge line.

The heat transfer plate may be so designed that a density of the first upper cross points is increasing in a direction from the second port hole towards the upper border line. According to this embodiment the first upper cross points are more densly arranged closer to the upper border line than more far away from the upper border line which may be beneficial since leakage between the flow channels is more likely to occur at the end of the flow channels, i.e. close to the upper border line.

The first upper cross points along one and the same of the upper ridge lines may be the upper cross points arranged closest to the upper border line.

Such a design may minimize leakage between the flow channels since leakage, as said above, is more likely to occur at the end of the flow channels, i.e. close to the upper border line.

The heat transfer plate may be so configured that at least one of said second upper cross points is a mirroring, parallel to the longitudinal center axis of the heat transfer plate, of a respective one of the first upper cross points.

Such an embodiment may enable an optimization as regards abutment between adjacent plates in a plate pack comprising heat transfer plates according to the present invention.

The first upper cross points and the second upper cross points together may be a minority of the upper cross points. Thereby, the flow channels may be closed only where required such that an optimized flow distribution across the plate can be achieved.

The heat transfer plate may be such that the imaginary upper ridge lines and the imaginary upper valley lines form a grid within the upper distribution area. The upper distribution valleys and the upper distribution ridges defining each mesh of the grid may enclose an area within which the heat transfer plate may extend in an imaginary second intermediate plane extending between the imaginary upper plane and the imaginary lower plane. Accordingly, the upper distribution pattern may be a so-called chocolate pattern which typically is associated with an effective flow distribution across the heat transfer plate. The imaginary second intermediate plane may be parallel to the imaginary upper and lower planes. Further, the imaginary second intermediate plane may, or may not, coincide with the imaginary first intermediate plane. A mesh may be open or closed.

A plurality of the upper distribution ridges may be arranged along each one of at least a plurality of the imaginary upper ridge lines. Further, a plurality of the upper distribution valleys may be arranged along each one of at least a plurality of the imaginary upper valley lines. Thereby, a plurality of upper cross points may be arranged along at least a plurality of the imaginary upper ridge and valley lines. This may facilitate the formation of a similar channels on the front and back sides of the heat transfer plate.

According to one embodiment of the heat transfer plate according to the invention the first and the third port hole are arranged at one and the same side of the longitudinal center axis of the heat transfer plate. Further, the lower distribution pattern comprises lower distribution ridges and lower distribution valleys, which may be elongate. The lower distribution ridges longitudinally extend along a plurality of separated imaginary lower ridge lines extending from the lower border line towards one of the third and the fourth port holes. The lower distribution valleys longitudinally extend along a plurality of separated imaginary lower valley lines extending from the lower border line towards the other one of the third and the fourth port hole. The imaginary lower ridge lines cross the imaginary lower valley lines in a plurality of lower cross points. In a number of first lower cross points of the lower cross points the heat transfer plate extends above the first intermediate plane, and in a number of second lower cross points of the lower cross points the heat transfer plate extends below the first intermediate plane. At least one of the first and second lower cross points is a mirroring, parallel to a transverse center axis of the heat transfer plate, of a respective one of the upper cross points. Such an embodiment may enable an optimization as regards abutment between adjacent plates in a plate pack comprising heat transfer plates according to the present invention.

With reference to the embodiment above, said one of the third and the fourth port hole may be the third port hole and said other one of the third and the fourth port hole may be the fourth port hole. Thereby, the imaginary lower ridge lines may extend from the lower border line towards the third port hole while the imaginary lower valley lines may extend from the lower border line towards the fourth port hole. Further, said first lower cross points may be arranged on said one side of the longitudinal center axis while said second lower cross points may be arranged on said another side of the longitudinal center axis. At least a majority of the first lower cross points may be a mirroring, parallel to the transverse center axis of the heat transfer plate, of a respective one of the first upper cross points. Such an embodiment may enable an optimization as regards abutment between adjacent plates in a plate pack comprising heat transfer plates according to the present invention, which plates are of so-called parallel flow type. A parallel-flow heat exchanger may comprise only one plate type.

Alternatively, said one of the third and the fourth port hole may be the fourth port hole and said other one of the third and the fourth port hole may be the third port hole. Thereby, the imaginary lower ridge lines may extend from the lower border line towards the fourth port hole while the imaginary lower valley lines may extend from the lower border line towards the third port hole. Further, said second lower cross points may be arranged on said one side of the longitudinal center axis while said first lower cross points may be arranged on said another side of the longitudinal center axis. At least a majority of the second lower cross points may be a mirroring, parallel to the transverse center axis of the heat transfer plate, of a respective one of the first upper cross points. Such an embodiment may enable an optimization as regards abutment between adjacent plates in a plate pack comprising heat transfer plates according to the present invention, which plates are of so-called diagonal flow type. A diagonal-flow heat exchanger may typically comprise more than one plate type.

The heat transfer plate may be so designed that a plurality of the imaginary upper ridge lines arranged closest to the second port hole, along at least part of their extension, are curved so as to bulge out as seen from the second port hole. This may contribute to an effective flow distribution across the heat transfer plate.

The upper and lower border lines may be non-straight, i.e. extend non-perpendicularly to the longitudinal center axis of the heat transfer plate. Thereby, the bending strength of the heat transfer plate may be increased as compared to if the upper and lower border lines instead were straight in which case the upper and lower border lines could serve as bending lines of the heat transfer plate. For example, the upper and lower border lines may be curved or arched or concave so as to bulge in as seen from the heat transfer area. Such curved upper and lower border lines are longer than corresponding straight upper and lower border lines would be, which results in a larger "outlet" and a larger "inlet" of the distribution areas. In turn, this may contribute to an effective flow distribution across the heat transfer plate.

It should be stressed that the advantages of most, if not all, of the above discussed features of the inventive heat transfer plate appear when the heat transfer plate is combined with other suitably constructed heat transfer plates, especially other heat transfer plates according to the present invention, in a plate pack of a plate heat exchanger in operation.

Still other objectives, features, aspects and advantages of the invention will appear from the following detailed description as well as from the drawings.

BRIEF DESCRIPTION OF THE DRAWINGS

The invention will now be described in more detail with reference to the appended schematic drawings, in which FIG. 1 schematically illustrates a plan view of a heat transfer plate.

It should be said that all of the figures referred to above, except FIG. 2, illustrate a tool for pressing a heat transfer plate according to the invention, and not the heat transfer plate itself. Therefore, the figures may not consistently show the heat transfer plate with 100% accuracy.

DETAILED DESCRIPTION

Figure 1:
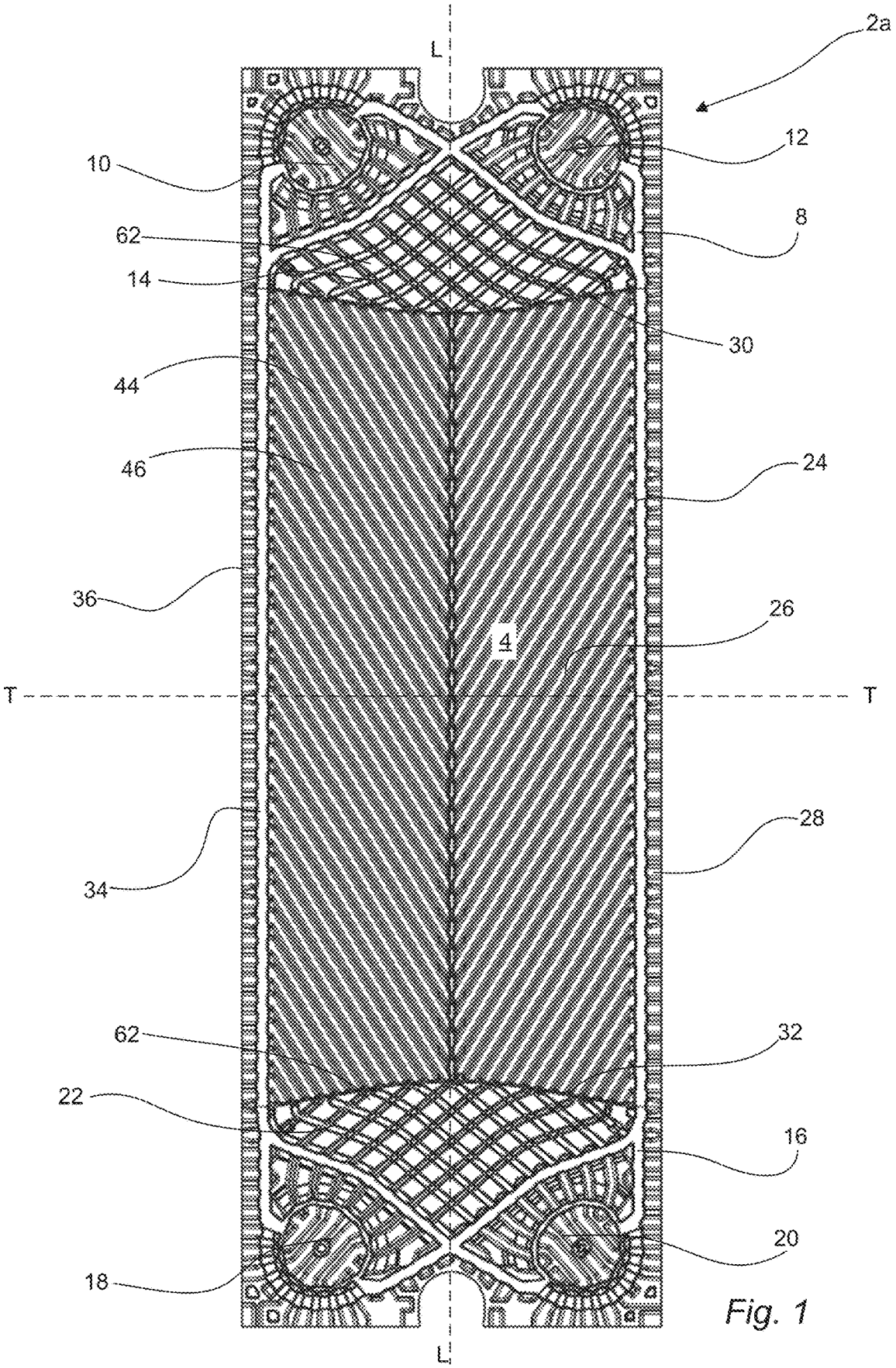
Figure 2:
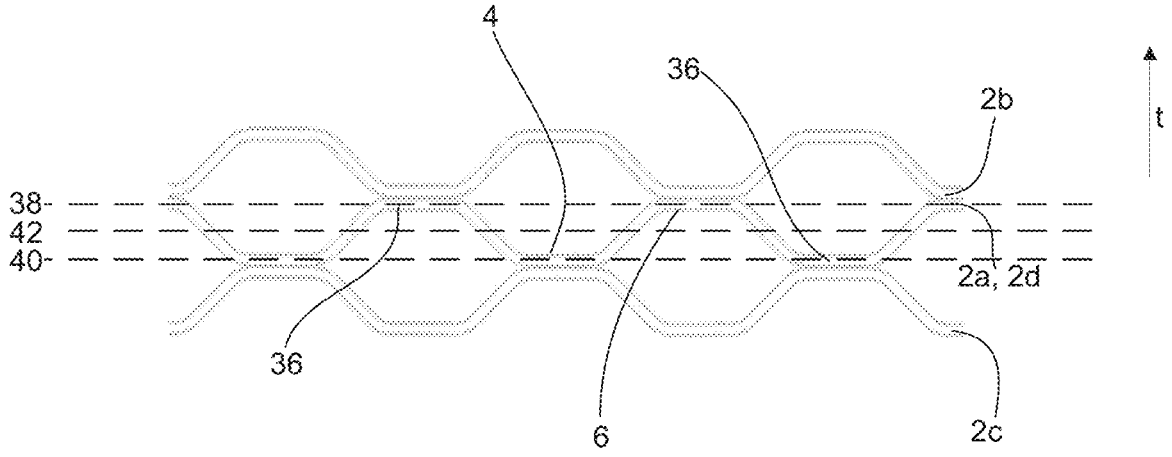
FIG. 2 illustrates abutting outer edges of adjacent heat transfer plates in a plate pack, as seen from the outside of the plate pack, FIG. 3*a* contains an enlargement of an upper distribution area of the heat transfer plate illustrated in FIG. 1, FIG. 3*b* contains an enlargement of a lower distribution area of the heat transfer plate illustrated in FIG. 1, and FIG. 4*a-h* schematically illustrate cross sections through the upper and the lower distribution area of the heat transfer plate illustrated in FIG. 1.

FIG. 1 shows a heat transfer plate 2*a* of a gasketed plate heat exchanger as described by way of introduction. The gasketed PHE, which is not illustrated in full, comprises a pack of heat transfer plates 2 like the heat transfer plate 2*a*, i.e. a pack of similar heat transfer plates, separated by gaskets, which also are similar and which are not illustrated. With reference to FIG. 2, in the plate pack, a front side 4 (illustrated in FIG. 1) of the plate 2*a* faces an adjacent plate 2*b* while a back side 6 (not visible in FIG. 1 but indicated in FIG. 2) of the plate 2*a* faces another adjacent plate 2*c*.

With reference to FIG. 1, the heat transfer plate 2*a* is an essentially rectangular sheet of stainless steel. It comprises an upper end portion 8, which in turn comprises an first port hole 10, a second port hole 12 and an upper distribution area 14. The plate 2*a* further comprises a lower end portion 16, which in turn comprises a third port hole 18, a fourth port hole 20 and a lower distribution area 22. The port holes 10, 12, 18 and 20 are illustrated un-cut or closed in FIG. 1. The lower end portion 16 is a mirroring, parallel to a transverse center axis T of the heat transfer plate 2*a*, of the upper end portion 8. The plate 2*a* further comprises a center portion 24, which in turn comprises a heat transfer area 26, and an outer edge portion 28 extending around the upper and lower end portions 8 and 16 and the center portion 24. The upper end portion 8 adjoins the center portion 24 along an upper border line 30 while the lower end portion 16 adjoins the center portion 24 along a lower border line 32. The upper and lower border lines 30 and 32 are arched so as to bulge towards each other. As is clear from FIG. 1, the upper end portion 8, the center portion 24 and the lower end portion 16 are arranged in succession along a longitudinal center axis L of the plate 2*a*, which extends perpendicular to the transverse center axis T of the plate 2*a*. As is also clear from FIG. 1, the first and third port holes 10 and 18 are arranged on one and the same side of the longitudinal center axis L, while the second and fourth port holes 12 and 20 are arranged on one and the other side of the longitudinal center axis L. Also, the heat transfer plate 2*a* comprises, as seen from the front side 4, a front gasket groove 34 and, as seen from the back side 6, a back gasket groove (not illustrated). The front and back gasket grooves are partly aligned with each other and arranged to receive a respective gasket.

The heat transfer plate 2*a* is pressed, in a conventional manner, in a pressing tool, to be given a desired structure, more particularly different corrugation patterns within different portions of the heat transfer plate. As was discussed by way of introduction, the corrugation patterns are optimized for the specific functions of the respective plate portions. Accordingly, the upper distribution area 14 is provided with an upper distribution pattern of so-called chocolate type, the lower distribution area 22 is provided with a lower distribution pattern of so-called chocolate type, and the heat transfer area 26 is provided with a heat transfer pattern. Further, the outer edge portion 28 comprises corrugations 36 which make the outer edge portion stiffer and, thus, the heat transfer plate 2*a* more resistant to deformation. Further, the corrugations 36 form a support structure in that they are arranged to abut corrugations of the adjacent heat transfer plates in the plate pack of the PHE. With reference also again to FIG. 2, illustrating the peripheral contact between the heat transfer plate 2*a* and the two adjacent heat transfer plates 2*b* and 2*c* of the plate pack, the corrugations 36 extend between and in an imaginary upper plane 38 and an imaginary lower plane 40, which are parallel to the figure plane of FIG. 1. The upper and lower planes 38 and 40 define, in a thickness direction t, an extreme extension of the complete plate 2*a*. An imaginary central extension plane 42 extends half way between the upper and lower planes 38 and 40. Here, a respective bottom of the front gasket groove 34 and the back gasket groove extends in the central extension plane 42 but this need not be the case in alternative embodiments.

With reference to FIGS. 1 and 2, the heat transfer pattern is of so-called herringbone type and comprises V-shaped heat transfer ridges 44 and heat transfer valleys 46 alternately arranged along the longitudinal center axis L and extending between and in the upper plane 38 and the lower plane 40. The heat transfer ridges and valleys 44 and 46 are symmetrical with respect to the central extension plane 42. Consequently, within the heat transfer area 26, a volume enclosed by the plate 2*a* and the upper plane 38 is essentially similar to a volume enclosed by the plate 2*a* and the lower plane 40. In an alternative embodiment, the heat transfer ridges and valleys 44 and 46 could instead be asymmetrical with respect to the central extension plane 42 so as to provide a volume enclosed by the plate 2*a* and the upper plane 38 which is different from a volume enclosed by the plate 2*a* and the lower plane 40.

Figure 3A:
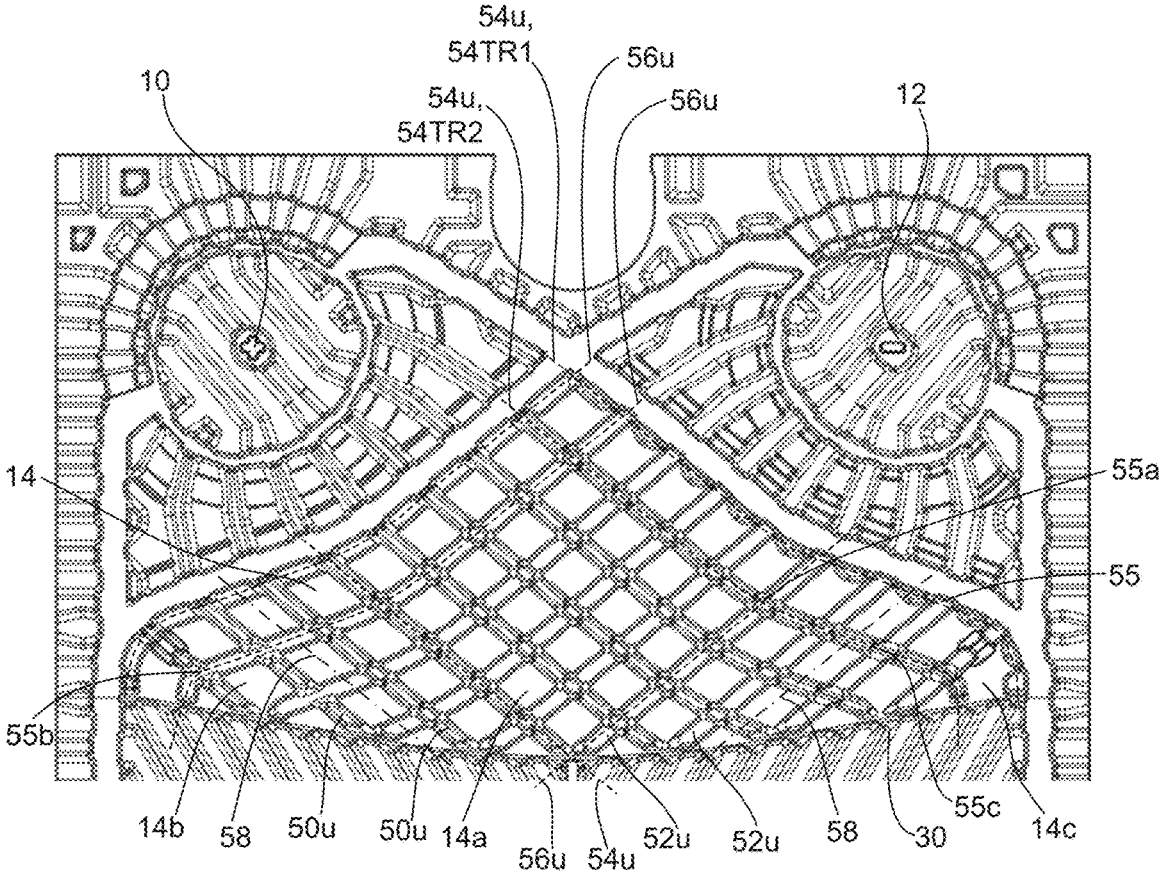
Figure 3B:
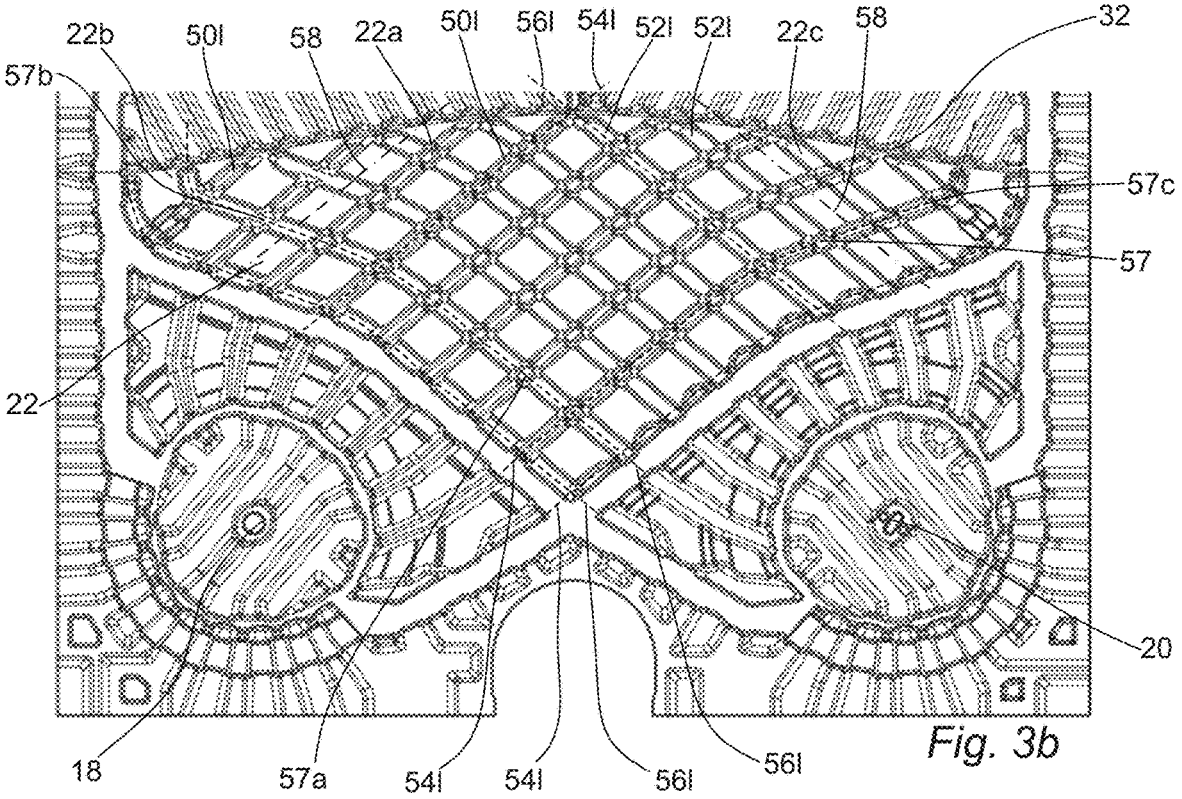

With reference to FIGS. 3*a* and 3*b*, which show enlargements of parts of the plate 2*a*, the upper and lower distribution area 14 and 22 each comprise a center part 14*a* and 22*a*, respectively, and two edge parts 14*b* & *c* and 22*b* & *c* arranged on opposite sides of the center parts 14*a* and 22*a*. The edge parts 14*b* and 22*b* are arranged on one and the same side of the longitudinal center axis L of the plate 2*a* while the edge parts 14*c* and 22*c* are arranged on one and the same side of the longitudinal center axis L of the plate 2*a*. The boundaries between the center and edge parts are illustrated by the ghost lines 58 in FIGS. 3*a* and 3*b*. Further, the upper and lower distribution patterns within the upper and lower distribution areas 14 and 22 each comprise elongate upper and lower distribution ridges 50*u* and 50*l*, respectively, and elongate upper and lower distribution valleys 52*u* and 52*l*, respectively. The upper and lower distribution ridges 50*u*, 50*l* are divided into groups containing a plurality, i.e. two or more, upper or lower distribution ridges 50*u*, 50*l* each. The upper and lower distribution ridges 50*u*, 50*l* of each group are arranged, longitudinally extending, along one of a number of separated imaginary upper and imaginary lower ridge lines 54*u* and 54*l*, respectively, of which only a few are illustrated by broken lines in FIGS. 3*a* and 3*b*. Similarly, the upper and lower distribution valleys 52*u*, 52*l* are divided into groups. The upper and lower distribution valleys 52*u*, 52*l* of each group are arranged, longitudinally extending, along one of a number of separated imaginary upper and lower valley lines 56*u* and 56*l*, respectively, of which only a few are illustrated by broken lines in FIGS. 3*a* and 3*b*. As is illustrated in FIG. 3*a*, in the upper distribution area 14 the imaginary upper ridge lines 54*u* extend from the upper border line 30 towards the first port hole 10 while the imaginary upper valley lines 56*u* extend from the upper border line 30 towards the second port hole 12. Similarly, as is illustrated in FIG. 3*b*, in the lower distribution area 22 the imaginary lower ridge lines 54*l* extend from the lower border line 32 towards the third port hole 18 while the imaginary lower valley lines 56*l* extend from the lower border line 32 towards the fourth port hole 20.

The imaginary upper ridge and valley lines 54*u* and 56*u* cross each other in a plurality of upper cross points 55 to form an imaginary grid within the upper distribution area 14. The upper cross points 55 within the center part 14*a* and the two edge parts 14*b* & *c* of the upper distribution area 14 are denoted 55*a*, 55*b* and 55*c*, respectively. In the claims, the "first upper cross points" correspond to the upper cross points 55*c* of the edge part 14*c* of the upper distribution area 14, and the "second upper cross points" correspond to the upper cross points 55*b* of the edge part 14*b* of the upper distribution area 14. Similarly, the imaginary lower ridge and valley lines 54*l* and 56*l* cross each other in a plurality of lower cross points 57 to form an imaginary grid within the lower distribution area 22. The lower cross points 57 within the center part 22*a* and the two edge parts 22*b* & *c* of the lower distribution area are denoted 57*a*, 57*b* and 57*c*, respectively. In the claims, the "first lower cross points" correspond to the lower cross points 57*c* of the edge part 22*c* of the lower distribution area 22, and the "second lower cross points" correspond to the lower cross points 57*b* of the edge part 22*b* of the lower distribution area 22. The upper and lower distribution ridges and distribution valleys 50*u*, 50*l*, 52*u* and 52*l* defining each mesh of the grids enclose a respective area 62 (FIG. 1). The meshes along the upper and lower border lines 30 and 32 are open while the rest of the meshes are closed.

Figure 4A:
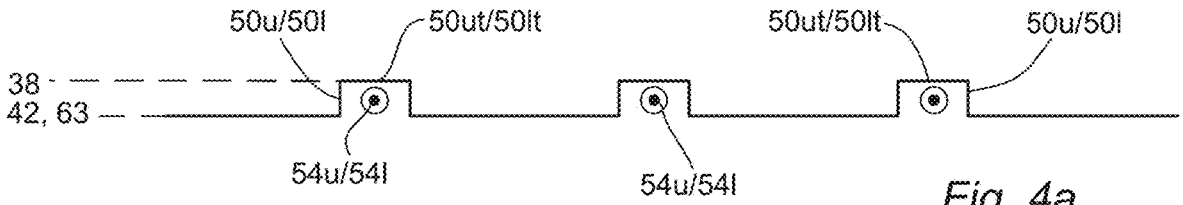
Figure 4B:
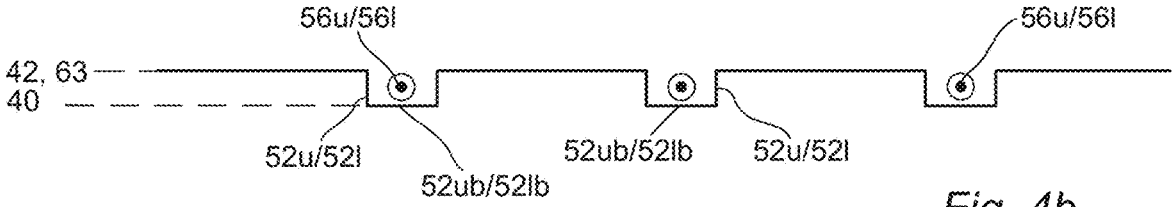
Figure 4C:
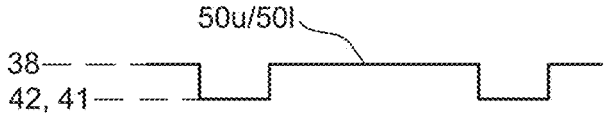
Figure 4D:
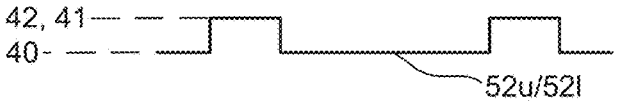
Figure 4E:
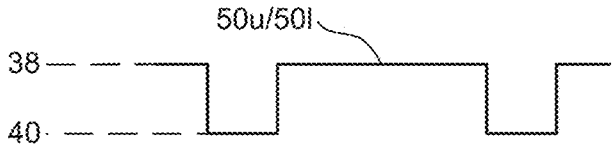
Figure 4F:
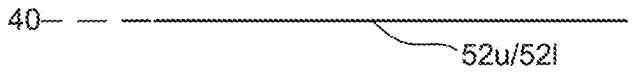
Figure 4G:
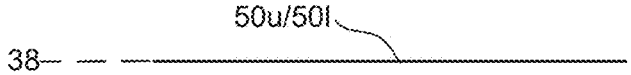
Figure 4H:
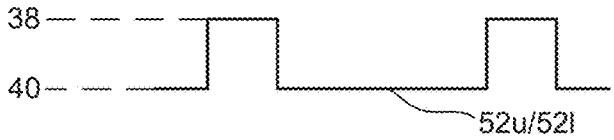

FIGS. 4*a*-4*h* schematically illustrate cross sections of the upper and lower distribution areas 14 and 22. With reference to FIGS. 3*a* and 3*b*, FIG. 4*a* shows cross sections of the plate between two adjacent ones of the imaginary upper valley lines 56*u* or between two adjacent ones of the imaginary lower valley lines 56*l*, while FIG. 4*b* shows cross sections of the plate between two adjacent ones of the imaginary upper ridge lines 54*u* or between two adjacent ones of the imaginary lower ridge lines 54*l*. Further, FIG. 4*c* shows cross sections of the plate along one of the imaginary upper ridge lines 54*u* within the center part 14*a* of the upper distribution area 14, or along one of the imaginary lower ridge lines 54*l* within the center part 22*a* of the lower distribution area 22. FIG. 4*d* shows cross sections of the plate along one of the imaginary upper valley lines 56*u* within the center part 14*a* of the upper distribution area 14, or along one of the imaginary lower valley lines 56*l* within the center part 22*a* of the lower distribution area 22. FIG. 4*e* shows cross sections of the plate along one of the imaginary upper ridge lines 54*u* within the edge part 14*b* of the upper distribution area 14, or along one of the imaginary lower ridge lines 54*l* within the edge part 22*b* of the lower distribution area 22. FIG. 4*f* shows cross sections of the plate along one of the imaginary upper valley lines 56*u* within the edge part 14*b* of the upper distribution area 14, or along one of the imaginary lower valley lines 56*l* within the edge part 22*b* of the lower distribution area 22. FIG. 4*g* shows cross sections of the plate along one of the imaginary upper ridge lines 54*u* within the edge part 14*c* of the upper distribution area 14, or along one of the imaginary lower ridge lines 54*l* within the edge part 22*c* of the lower distribution area 22. FIG. 4*h* shows cross sections of the plate along one of the imaginary upper valley lines 56*u* within the edge part 14*c* of the upper distribution area 14, or along one of the imaginary lower valley lines 56*l* within the edge part 22*c* of the lower distribution area 22.

With reference to FIGS. 4*a*-4*h*, a respective top portion 50*ut* and 50*lt* of the upper and lower distribution ridges 50*u* and 50*l* extends in the upper plane 38 and a respective bottom portion 52*ub* and 52*lb* of the upper and lower distribution valleys 52*u* and 52*l* extends in the lower plane 40. Within the areas 62 the heat transfer plate 2*a* extends in an imaginary second intermediate plane 63. Within the center parts 14*a* and 22*a* of the upper and lower distribution areas 14 and 22, respectively, between two adjacent ones of the upper distribution ridges 50*u* or the lower distribution ridges 50*l* or the upper distribution valleys 52*u* or the lower distribution valleys 52*l*, i.e. in the upper and lower cross points 55*a* and 57*a*, the heat transfer plate 2*a* extends in an imaginary first intermediate plane 41. Here, the imaginary first intermediate plane 41 and second intermediate plane 63 coincide with the central extension plane 42. In an alternative embodiment the first and second intermediate planes 41 and 63 could instead be displaced from the central extension plane 42. Within the edge parts 14*c* and 22*c* of the upper and lower distribution areas 14 and 22, respectively, between two adjacent ones of the upper distribution ridges 50*u* or the lower distribution ridges 50*l* (FIG. 4*g*) or the upper distribution valleys 52*u* or the lower distribution valleys 52*l* (FIG. 4*h*), i.e. in the upper and lower cross points 55*c* and 57*c*, the heat transfer plate 2*a* extends in the imaginary upper plane 38. Within the edge parts 14*b* and 22*b* of the upper and lower distribution areas 14 and 22, respectively, between two adjacent ones of the upper distribution ridges 50*u* or the lower distribution ridges 50*l* (FIG. 4*e*) or the upper distribution valleys 52*u* or the lower distribution valleys 52*l* (FIG. 4*f*), i.e. in the upper and lower cross points 55*b* and 57*b*, the heat transfer plate 2*a* extends in the imaginary lower plane 40.

Thus, in a majority of the upper and lower cross points 55 and 57, the heat transfer plate extends in the central extension plane 42. However, in some of the upper and lower cross points, here the three upper cross points 55*c* within the edge part 14*c* of the upper distribution area 14 and the three lower cross points 57*c* within the edge part 22*c* of the lower distribution area 22, the heat transfer plate instead extends in the upper plane 38. Further, in some of the upper and lower cross points, here the three upper cross points 55*b* within the edge part 14*b* of the upper distribution area 14 and the three lower cross points 57*b* within the edge part 22*b* of the lower distribution area 22, the heat transfer plate instead extends in the lower plane 40. Thereby, partly closed flow channels are defined in the upper and lower distribution areas 14 and 22.

The longest one of the imaginary upper ridge lines 54*u*, which is the imaginary upper ridge line arranged closest, of the upper ridge lines 54*u*, to the second port hole 12, is hereinafter referred to as the first top upper ridge line 54TR1. Analogously, the second longest one of the imaginary upper ridge lines 54*u*, which is the imaginary upper ridge line arranged second closest, of the upper ridge lines 54*u*, to the second port hole 12, is hereinafter referred to as the second top upper ridge line 54TR2. Further, the third longest one of the imaginary upper ridge lines 54*u*, which is the imaginary upper ridge line arranged third closest, of the upper ridge lines 54*u*, to the second port hole 12, is hereinafter referred to as the third top upper ridge line. The two upper cross points 55 along the second top upper ridge line 54TR2 arranged closest to the upper border line 30 are upper cross points 55*c*. Also, the upper cross point 55 along the third top upper ridge line arranged closest to the upper border line 30 is an upper cross point 55*c*. Thus, the upper cross points 55*c* are gathered close to the upper border line 30.

The upper cross points arranged on one side of the longitudinal center axis L of the heat transfer plate are mirrorings, parallel to the longitudinal center axis L, of the upper cross points arranged on the other side of the longitudinal center axis L. Further, each of the three second upper cross points 55*b* is a mirroring, parallel to the longitudinal center axis L, of a respective one of the three first upper cross points 55*c*. Thus, a paragraph corresponding to the paragraph above, with appropriate changes, is valid also for the upper cross points 55*b*.

As said above, the lower end portion 16 is a mirroring, parallel to the transverse center axis T of the heat transfer plate 2*a*, of the upper end portion 8. Thus, paragraphs corresponding to the three above paragraphs above, with appropriate changes, are valid also for the lower end portion 16, and especially the lower distribution area 22.

As previously said, in the plate pack, the plate 2*a* is arranged between the plates 2*b* and 2*c*. The plates 2*b* and 2*c* may be arranged either "flipped" or "rotated" in relation to the plate 2*a*.

If the plates 2*b* and 2*c* are arranged "flipped" in relation to the plate 2*a*, the front side 4 and back side 6 of plate 2*a* face the front side 4 of plate 2*b* and the back side 6 of plate 2*c*, respectively. This means that the ridges of plate 2*a* will abut the ridges of plate 2*b* while the valleys of plate 2*a* will abut the valleys of plate 2*c*. More particularly, the heat transfer ridges 44 and heat transfer valleys 46 of the plate 2*a* will abut, in pointlike contact areas, the heat transfer ridges 44 of the plate 2*b* and the heat transfer valleys 46 of the plate 2*c*, respectively. Further, the upper and lower distribution ridges 50*u* and 50*l* of the plate 2*a* will abut, in elongate contact areas, the lower and upper distribution ridges 50*l* and 50*u*, respectively, of the plate 2*b*, while the upper and lower distribution valleys 52*u* and 52*l* of the plate 2*a* will abut, in elongate contact areas, the lower and upper distribution valleys 52*l* and 52*u*, respectively, of the plate 2*c*. Especially, the plate 2*a* will, in its upper cross points 55*c* and its lower cross points 57*c*, be aligned with and abut the plate 2*b* in its lower cross points 57*c* and its upper cross points 55*c*, respectively. Further, the plate 2*a* will, in its upper cross points 55*b* and its lower cross points 57*b*, be aligned with and abut the plate 2*c* in its lower cross points 57*b* and its upper cross points 55*b*, respectively.

Thus, the flow or distribution channels of the plates will be aligned so as to form distribution flow tunnels between the distribution areas of the plates. The longest distribution flow tunnels will, close to the upper and lower border lines be closed so as to prevent leakage between tunnels, which will improve the flow distribution across the plates.

If the plates 2*b* and 2*c* are arranged "rotated" in relation to the plate 2*a*, the front side 4 and back side 6 of plate 2*a* face the back side 6 of plate 2*b* and the front side 4 of plate 2*c*, respectively. This means that the ridges of plate 2*a* will abut the valleys of plate 2*b* while the valleys of plate 2*a* will abut the ridges of plate 2*c*. More particularly, the heat transfer ridges 44 and heat transfer valleys 46 of the plate 2*a* will abut, in pointlike contact areas, the heat transfer valleys 46 of the plate 2*b* and the heat transfer ridges 44 of the plate 2*c*, respectively. Further, the upper and lower distribution ridges 50*u* and 50*l* of the plate 2*a* will abut, in elongate contact areas, the lower and upper distribution valleys 52*l* and 52*u*, respectively, of the plate 2*b*, while the upper and lower distribution valleys 52*u* and 52*l* of the plate 2*a* will abut, in elongate contact areas, the lower and upper distribution ridges 50*l* and 50*u*, respectively, of the plate 2*c*. Especially, the plate 2*a* will, in its upper cross points 55*c* and its lower cross points 57*c*, be aligned with and abut the plate 2*b* in its lower cross points 57*b* and its upper cross points 55*b*, respectively. Further, the plate 2*a* will, in its upper cross points 55*b* and its lower cross points 57*b*, be aligned with and abut the plate 2*c* in its lower cross points 57*c* and its upper cross points 55*c*, respectively.

The above described heat transfer plate 2*a* illustrated in FIGS. 1 and 3*a*-3*b* is of parallel flow type which means that the inlet and outlet port holes for a first fluid are arranged on one side of the longitudinal center axis L of the heat transfer plate, while the inlet and outlet port holes for a second fluid are arranged on another side of the longitudinal center axis L of the heat transfer plate. In a plate pack of plates of parallel flow type, all plates may, but need not, be similar. According to an alternative embodiment of the invention, the heat transfer plate is of diagonal flow type which means that the inlet and outlet port holes for a first fluid are arranged on opposite sides of the longitudinal center axis L of the heat transfer plate, and the inlet and outlet port holes for a second fluid are arranged on opposite sides of the longitudinal center axis L of the heat transfer plate. A plate pack of plates of diagonal flow type typically comprises at least two different types of plates.

On a diagonal flow type plate the lower end portion is typically not a mirroring, parallel to the transverse center axis of the plate, of the upper end portion. Instead, the upper and lower distribution patterns may have a similar design. A heat transfer plate 2*d* (schematically illustrated in FIG. 2) of diagonal flow type according to one embodiment of the invention is designed as described above except for as regards the lower distribution area 22. More particularly, in the lower distribution area 22 the imaginary lower ridge lines 54*l* extend from the lower border line 32 towards the fourth port hole 20 while the imaginary lower valley lines 56*l* extend from the lower border line 32 towards the third port hole 18. The edge part 22*b* of the lower distribution area 22 is arranged on one and the same side of the longitudinal center axis L of the plate 2*d* as the edge part 14*c* of the upper distribution area 14, while the edge part 22*c* of the lower distribution area 22 is arranged on one and the same side of the longitudinal center axis L of the plate 2*d* as the edge part 14*b* of the upper distribution area 14. Further, the three lower cross points 57*b*, in which the heat transfer plate 2*d* extends in the lower plane 40, are arranged on one and the same side of the longitudinal center axis L as the three upper cross points 55*c*, while the three lower cross points 57*c*, in which the heat transfer plate extends in the upper plane 38, are arranged on one and the same side of the longitudinal center axis L as the three upper cross points 55*b*. More particularly, each of the lower cross points 57*b* is a mirroring, parallel to the transverse center axis T of the heat transfer plate 2*d*, of a respective one of the first upper cross points 55*c*, while each of the lower cross points 57*c* is a mirroring, parallel to the transverse center axis T of the heat transfer plate 2*d*, of a respective one of the first upper cross points 55*b*. Otherwise, the lower distribution area 22 of the plate 2*d* is designed like the lower distribution area 22 of the plate 2*a*.

In a plate pack of plates of diagonal flow type, the plate 2*d* is arranged between the plates 2*b* and 2*c*. The plates 2*b* and 2*c*, which are of the same type, are designed like the plate 2*d*, except for within the upper and lower distribution areas. More particularly, the upper and lower distribution areas of the plates 2*b* and 2*c* are mirrorings, parallel to longitudinal center axes of the plates, of the upper and lower distribution areas of the plate 2*d*. The plates 2*b* and 2*c* may be arranged either "flipped" or "rotated" in relation to the plate 2*d* so as to achieve the mutual plate abutment described above.

The above described embodiments of the present invention should only be seen examples. A person skilled in the art realizes that the embodiments discussed can be varied in a number of ways without deviating from the inventive conception.

In the above described embodiments, the heat transfer plate extends in the imaginary upper plane 38 in the upper cross points 55*c* and the lower cross points 57*c*, and in the imaginary lower plane 40 in the upper cross points 55*b* and the lower cross points 57*b*. In alternative embodiments, the heat transfer plate could instead, in the upper cross points 55*c* and the lower cross points 57*c*, extend in an imaginary plane arranged between the central extension plane 42 and the upper plane 38, and in the upper cross points 55*b* and the lower cross points 57*b*, extend in an imaginary plane arranged between the central extension plane 42 and the lower plane 40. Thereby, partly closed flow channels would be formed.

In the above described embodiments, there are three each of the upper and lower cross points 55*b*, 55*c*, 57*b* and 57*c*. In alternative embodiments, there could be more or less than three of one or more of the upper and lower cross points 55*b*, 55*c*, 57*b* and 57*c*.

In the above described embodiments each set of the upper and lower cross points 55*b*, 55*c*, 57*b* and 57*c* are arranged along two respective adjacent ones of the imaginary upper or lower ridge or valley lines. In alternative embodiments, each set of the upper and lower cross points 55*b*, 55*c*, 57*b* and 57*c* could instead be arranged along a respective single one, or along more than two respective adjacent ones, of the imaginary upper or lower ridge or valley lines. Alternatively, each set of the upper and lower cross points 55*b*, 55*c*, 57*b* and 57*c* could be arranged along two or more respective non-adjacent ones of the imaginary upper or lower ridge or valley lines.

Further, the upper and lower cross points 55*b*, 55*c*, 57*b* and 57*c* need not be arranged along the second, third, etc. longest ones of the imaginary ridge and valley lines but could instead be arranged along shorter ones of the imaginary ridge and valley lines. Also, the upper and lower cross points 55*b*, 55*c*, 57*b* and 57*c* need not be the upper and lower cross points arranged closest to the upper and lower border lines but could be upper and lower cross points arranged further away from the upper and lower border lines.

For example, the heat transfer area may comprise other heat transfer patterns than the one described above. Further, the upper and lower distribution patterns need not be of chocolate type but may have other designs.

Some or all of the distribution ridges and valleys need not be designed as illustrated in the figures but may have other designs.

The plate illustrated in the figures is so designed that the longer imaginary upper and lower ridge and valley lines are partly curved while the shorter imaginary upper and lower ridge and valley lines are straight. This need not be the case. Instead, the imaginary upper and lower, ridge and valley lines could all be straight, or all be (possibly partly) curved. Further, the upper and lower border lines need not be curved but could have other forms. For example, they could be straight or zig-zag shaped.

The heat transfer plate could additionally comprise a transition band, like the ones described in EP 2957851, EP 2728292 or EP 1899671, between the heat transfer and distribution areas. Such a plate may be "rotatable" but not "flippable".

The present invention is not limited to gasketed plate heat exchangers but could also be used in welded, semi-welded, brazed and fusion-bonded plate heat exchangers.

The heat transfer plate need not be rectangular but may have other shapes, such as essentially rectangular with rounded corners instead of right corners, circular or oval. The heat transfer plate need not be made of stainless steel but could be of other materials, such as titanium or aluminium.

It should be stressed that the attributes front, back, upper, lower, first, second, etc. is used herein just to distinguish between details and not to express any kind of orientation or mutual order between the details.

Further, it should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

The invention claimed is:

1. A heat transfer plate comprising an upper end portion, a center portion and a lower end portion arranged in succession along a longitudinal center axis of the heat transfer plate, the upper end portion comprising a first and a second port hole and an upper distribution area provided with an upper distribution pattern, the lower end portion comprising a third and a fourth port hole and a lower distribution area provided with a lower distribution pattern, and the center portion comprising a heat transfer area provided with a heat transfer pattern differing from the upper and lower distribution patterns, the upper end portion adjoining the center portion along an upper border line and the lower end portion adjoining the center portion along a lower border line, wherein the upper distribution pattern comprises upper distribution ridges and upper distribution valleys, a respective top portion of the upper distribution ridges extending in an imaginary upper plane, and a respective bottom portion of the upper distribution valleys extending in an imaginary lower plane, which upper and lower planes define, in a thickness direction, an extreme extension of the heat transfer plate within the upper distribution area, the upper distribution ridges longitudinally extending along a plurality of separated imaginary upper ridge lines extending from the upper border line towards the first port hole, the upper distribution valleys longitudinally extending along a plurality of separated imaginary upper valley lines extending from the upper border line towards the second port hole, wherein the imaginary upper ridge lines cross the imaginary upper valley lines in a plurality of upper cross points, wherein the heat transfer plate, in a plurality of the upper cross points, extends in an imaginary first intermediate plane extending parallel to and between the upper plane and the lower plane, the heat transfer plate, in a number of first upper cross points of the upper cross points arranged on one side of the longitudinal center axis, extends above the first intermediate plane, and the heat transfer plate, in a number of second upper cross points of the upper cross points arranged on another side of the longitudinal center axis, extends below the first intermediate plane.

2. A heat transfer plate according to claim 1, wherein said first cross points are arranged on the same side of the longitudinal center axis as the second port hole and the second cross points are arranged on the same side of the longitudinal center axis as the first port hole.

3. A heat transfer plate according to claim 1, wherein the heat transfer plate in said first upper cross points extends in the upper plane and the heat transfer plate in said second upper cross points extends in the lower plane.

4. A heat transfer plate according to claim 1, wherein at least one of said first upper cross points is arranged along a second top upper ridge line of the upper ridge lines, which second top upper ridge line is arranged second closest, of the upper ridge lines, to the second port hole.

5. A heat transfer plate according to claim 4, wherein more of said first upper cross points are arranged along the second top upper ridge line than along any of the other upper ridge lines.

6. A heat transfer plate according to claim 1, wherein said first upper cross points are arranged along the x≥1 longest ones of the upper ridge lines arranged on an inside of a first top upper ridge line of the upper ridge lines, which first top upper ridge line is arranged closest, of the upper ridge lines, to the second port hole, wherein at least one of said first upper cross points is arranged along each one of said x longest ones of the upper ridge lines.

7. A heat transfer plate according to claim 1, wherein a density of said first upper cross points is increasing in a direction from the second port hole towards the upper border line.

8. A heat transfer plate according to claim 1, wherein the first upper cross points along one and the same of the upper ridge lines are the upper cross points arranged closest to the upper border line.

9. A heat transfer plate according to claim 1, wherein at least one of said second upper cross points is a mirroring, parallel to the longitudinal center axis of the heat transfer plate, of a respective one of the first upper cross points.

10. A heat transfer plate according to claim 1, wherein the first upper cross points and the second upper cross points together is a minority of the upper cross points.

11. A heat transfer plate according to claim 1, wherein the imaginary upper ridge lines and the imaginary upper valley lines form a grid within the upper distribution area, wherein the upper distribution valleys and the upper distribution ridges defining each mesh of the grid enclose an area within which the heat transfer plate extends in an imaginary second intermediate plane extending between the imaginary upper plane and the imaginary lower plane.

12. A heat transfer plate according to claim 1, wherein a plurality of the upper distribution ridges are arranged along each one of at least a plurality of the imaginary upper ridge lines, and a plurality of the upper distribution valleys are arranged along each one of at least a plurality of the imaginary upper valley lines.

13. A heat transfer plate according to claim 1, wherein the first and the third port hole are arranged at one and the same side of the longitudinal center axis of the heat transfer plate, and wherein the lower distribution pattern comprises lower distribution ridges and lower distribution valleys, the lower distribution ridges longitudinally extending along a plurality of separated imaginary lower ridge lines extending from the lower border line towards one of the third and the fourth port holes, the lower distribution valleys longitudinally extending along a plurality of separated imaginary lower valley lines extending from the lower border line towards the other one of the third and the fourth port hole, wherein the imaginary lower ridge lines cross the imaginary lower valley lines in a plurality of lower cross points, wherein the heat transfer plate in a number of first lower cross points of the lower cross points extends above the first intermediate plane, and the heat transfer plate in a number of second lower cross points of the lower cross points extends below the first intermediate plane, wherein at least one of the first and second lower cross points is a mirroring, parallel to a transverse center axis of the heat transfer plate, of a respective one of the upper cross points.

14. A heat transfer plate according to claim 13, wherein said one of the third and the fourth port hole is the third port hole and said other one of the third and the fourth port hole is the fourth port hole, and said first lower cross points are arranged on said one side of the longitudinal center axis and said second lower cross points are arranged on said another side of the longitudinal center line, wherein at least a majority of the first lower cross points is a mirroring, parallel to the transverse center axis of the heat transfer plate, of a respective one of the first upper cross points.

15. A heat transfer plate according to claim 13, wherein said one of the third and the fourth port hole is the fourth port hole and said other one of the third and the fourth port hole is the third port hole, and said second lower cross points are arranged on said one side of the longitudinal center axis and said first lower cross points are arranged on said another side of the longitudinal center line, wherein at least a majority of the second lower cross points is a mirroring, parallel to the transverse center axis of the heat transfer plate, of a respective one of the first upper cross points.

* * * * *